US007552998B2

(12) United States Patent
Yonekawa et al.

(10) Patent No.: US 7,552,998 B2
(45) Date of Patent: Jun. 30, 2009

(54) METHOD AND APPARATUS FOR IMAGE FORMING CAPABLE OF INCREASING MAINTENANCE EFFICIENCY

(75) Inventors: Masahiro Yonekawa, Machida (JP); Ryota Yano, Yokohama (JP); Hiroshi Obara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 351 days.

(21) Appl. No.: 11/251,931

(22) Filed: Oct. 18, 2005

(65) Prior Publication Data

US 2006/0082622 A1 Apr. 20, 2006

(30) Foreign Application Priority Data

Oct. 18, 2004 (JP) ..... 2004-302930

(51) Int. Cl.
*B41J 2/14* (2006.01)

(52) U.S. Cl. ..... 347/49

(58) Field of Classification Search ..... 347/5, 347/23, 49, 108; 399/4, 12
See application file for complete search history.

(56) References Cited

U.S. PATENT DOCUMENTS 5,777,638 A * 7/1998 Salter et al. ..... 347/12
5,992,965 A * 11/1999 Katayanagi et al. ..... 347/29
6,053,608 A * 4/2000 Ishii et al. ..... 347/88
6,065,831 A * 5/2000 Kawaura et al. ..... 347/108
6,091,912 A * 7/2000 Kitajima et al. ..... 399/13
6,142,617 A * 11/2000 Barinaga et al. ..... 347/85
6,328,415 B1 * 12/2001 Norton et al. ..... 347/37
6,739,710 B2 * 5/2004 Lin et al. ..... 347/86
6,789,876 B2 * 9/2004 Barclay et al. ..... 347/37
6,877,920 B2 * 4/2005 Fujioka ..... 400/613
7,044,570 B2 * 5/2006 Takahashi et al. ..... 347/8
7,150,520 B2 * 12/2006 Shinada et al. ..... 347/86
7,155,148 B2 * 12/2006 Nishimura et al. ..... 399/257

FOREIGN PATENT DOCUMENTS

JP 2004-106397 4/2004
JP 2004-276472 10/2004
JP 2004-284093 10/2004

* cited by examiner

*Primary Examiner*—Anh T. N. Vo
(74) *Attorney, Agent, or Firm*—Oblon, Spivak, McClelland, Maier & Neustadt, P.C.

(57) ABSTRACT

An image forming apparatus includes a plurality of recording liquid cartridges, a cartridge holder, and a cover. The plurality of recording liquid cartridges contain recording liquids of colors different from each other. The cartridge holder holds the plurality of recording liquid cartridges in the apparatus. The cover includes a see-through portion through which the plurality of recording liquid cartridges are visible, and encloses the plurality of recording liquid cartridges held by the cartridge holder inside the apparatus. The cover is opened to allow an operator access to exchange each of the plurality of recording liquid cartridges.

16 Claims, 13 Drawing Sheets

METHOD AND APPARATUS FOR IMAGE FORMING CAPABLE OF INCREASING MAINTENANCE EFFICIENCY

CROSS-REFERENCE TO RELATED APPLICATION

The present application is based on and claims priority to Japanese patent application No. 2004-302930 filed on Oct. 18, 2004 in the Japan Patent Office, the entire contents of which are hereby incorporated herein by reference.

BACKGROUND OF THE INVENTION

1. Field of the Invention

The present invention relates to a method and apparatus for image forming, and more particularly to a method and apparatus for image forming capable of increasing maintenance efficiency with a structure in which an operator can easily check amounts of ink remaining in ink cartridges.

2. Description of the Background Art

A background inkjet recording apparatus is generally compact and convenient for color image reproduction and therefore it has been widely used in a form of various types of image forming apparatuses such as a printer, a facsimile machine, a copying machine, a plotter, and so on. In such a background inkjet recording apparatus, a plurality of recording heads are provided for different colors (e.g., yellow, magenta, cyan, and black) and eject ink drops of different colors onto a recording medium (e.g., a recording sheet) so as to record a color image on the recording medium.

The background inkjet recording apparatus is generally provided with a convenient ink cartridge system in which an ink tank for each color ink is separated into a main tank and a sub tank connected to each other with a flexible tube. The main tank includes an ink cartridge and is exchangeable for replacement, and the sub tank is disposed on the recording head. The main tank is configured to communicate with the sub tank through the flexible tube so that ink is supplied from the main tank to the sub tank when an amount of ink in the sub tank decreases.

The above-described main tank is typically provided inside the background inkjet recording apparatus, and therefore is not easy for an operator to predict a time to exchange the main tank.

SUMMARY OF THE INVENTION

This specification describes a novel image forming apparatus. In one aspect of the present invention, the novel image forming apparatus includes a plurality of recording liquid cartridges, a cartridge holder, and a cover. The plurality of recording liquid cartridges are configured to contain recording liquids of colors different from each other. The cartridge holder is configured to hold the plurality of recording liquid cartridges in the apparatus. The cover includes a see-through portion and is configured to enclose the plurality of recording liquid cartridges held by the cartridge holder inside the apparatus. The cover can be opened to allow an operator access to exchange each of the plurality of recording liquid cartridges.

The novel image forming apparatus may further include a plurality of indicators. The plurality of indicators may indicate information relating to amounts of the recording liquids remaining in the plurality of recording liquid cartridges and may be disposed on the cartridge holder at positions corresponding to respective positions of the plurality of recording liquid cartridges placed in the cartridge holder.

Each of the plurality of indicators may emit light in a color representing a color of a recording liquid contained in a corresponding one of the plurality of recording liquid cartridges.

The novel image forming apparatus may further include a plurality of indexes. Each of the plurality of indexes may be disposed near a corresponding indicator of the plurality of indicators and may indicate a color representing a color of a recording liquid contained in a corresponding one of the plurality of recording liquid cartridges.

The plurality of recording liquid cartridges may be placed in a portrait orientation and horizontally aligned in the cartridge holder.

This specification describes a novel image forming method which ejects ink drops onto a recording sheet to record an image on the recording sheet. In one aspect of the present invention, the novel image forming method includes keeping recording liquids of colors different from each other in a plurality of recording liquid cartridges, holding the plurality of recording liquid cartridges with a cartridge holder in the apparatus, enclosing the plurality of recording liquid cartridges held by the cartridge holder inside the apparatus with a cover including a see-through portion, and opening the cover to allow an operator access to exchange each of the plurality of recording liquid cartridges.

In another aspect of the present invention, the novel image forming method may further include forming a plurality of indicators on the cartridge holder at positions corresponding to respective positions of the plurality of recording liquid cartridges placed in the cartridge holder to indicate information relating to amounts of the recording liquids remaining in the plurality of recording liquid cartridges.

In yet another aspect of the present invention, the novel image forming method may further include emitting light in a color representing a color of a recording liquid contained in a corresponding one of the plurality of recording liquid cartridges.

In yet another aspect of the present invention, the novel image forming method may further include forming each of a plurality of indexes near a corresponding indicator of the plurality of indicators to indicate a color representing a color of a recording liquid contained in a corresponding one of the plurality of recording liquid cartridges.

In yet another aspect of the present invention, the novel image forming method may further include placing the plurality of recording liquid cartridges in a portrait orientation and horizontally aligning the plurality of recording liquid cartridges in the cartridge holder.

BRIEF DESCRIPTION OF THE DRAWINGS

A more complete appreciation of the invention and many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
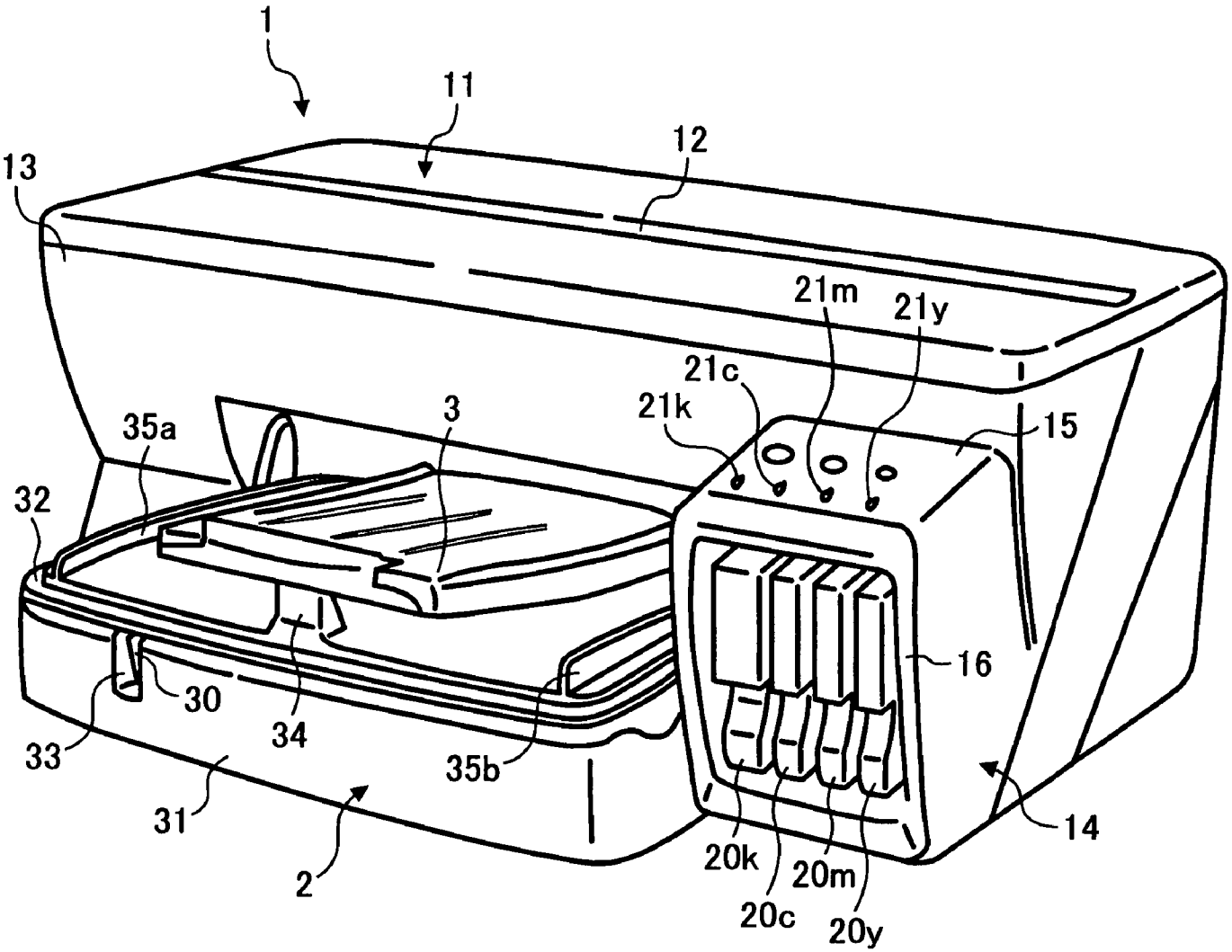
FIG. 1 is a front perspective view of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 1 and 2, an image forming apparatus according to an exemplary embodiment of the present invention is explained.

Figure 2:
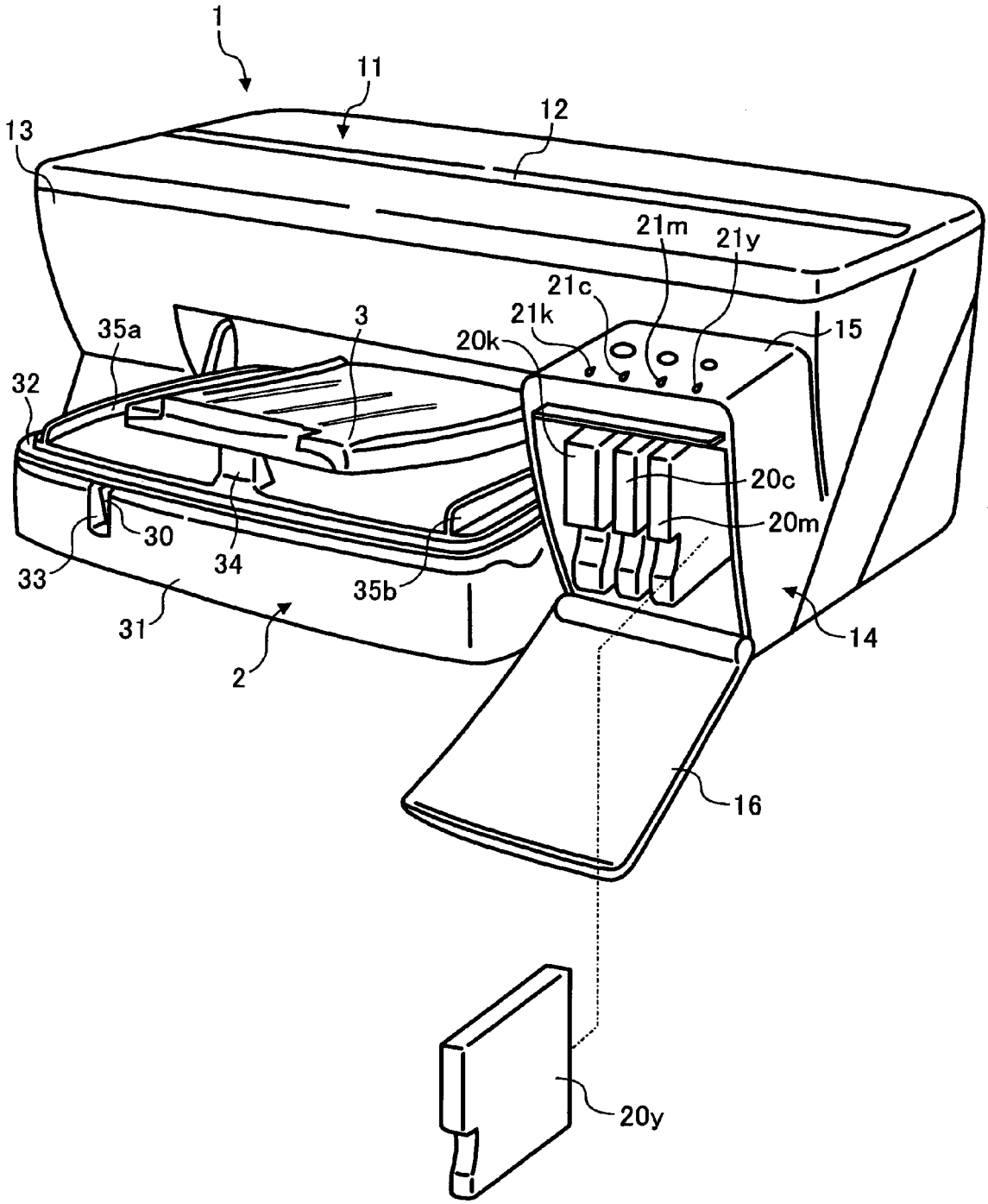
FIG. 2 is a front perspective view of the image forming apparatus shown in FIG. 1 with a front cover opened.

As illustrated in FIGS. 1 and 2, an image forming apparatus 1 includes a top cover 11, a front 13, a paper tray 2, and an output tray 3.

The top cover 11 includes a window 12.

The front 13 includes an ink cartridge holder 14. The ink cartridge holder 14 includes a control panel 15, a front cover 16, and ink cartridges 20*k*, 20*c*, 20*m*, and 20*y* (hereinafter referred to as an ink cartridge 20 when a color of ink is not specified). The control panel 15 includes indicators 21*k*, 21*c*, 21*m*, and 21*y* (hereinafter referred to as an indicator 21 when a color of ink is not specified).

The paper tray 2 includes a tray 31 and a tray cover 32. The tray 31 includes a window 33. The tray cover 32 includes a support 34 and ribs 35*a* and 35*b*.

The image forming apparatus 1 is configured to function as an inkjet recording device.

The top cover 11 is configured to cover a mechanism inside the image forming apparatus 1. The top cover 11 is disposed on a top of the image forming apparatus 1 to form a top surface of the image forming apparatus 1. The top cover 11 can be opened and closed. A surface of the top cover 11 is substantially flat.

The window 12 is provided on a center of the surface of the top cover 11. The window 12 includes a see-through portion, for example a transparent or a translucent member, through which the mechanism inside the image forming apparatus 1 can be visually checked. An operator can check whether the mechanism, for example a carriage, inside the image forming apparatus 1 moves or not by looking through the window 12 as well as by listening to a sound caused by the mechanism while it moves. Thus, the window 12 serves as an improved user interface. Even if the mechanism is configured to stop when the top cover 11 is opened, the operator can visually check whether the mechanism moves or not while the top cover 11 is closed. Thus, the window 12 causes the operator to more easily perform maintenance.

The front 13 is configured to cover the mechanism inside the image forming apparatus 1. The front 13 is disposed on a front of the image forming apparatus 1 and makes an acute angle with a top surface of the top cover 11. A front edge of the top cover 11 protrudes toward the operator standing in front of the image forming apparatus 1. Thus, the image forming apparatus 1 looks like a compact size apparatus while it offers a space providing usability on the top cover 11. The operator may recognize the image forming apparatus 1 as a small size apparatus which offers the space providing usability on the top cover 11 even if it handles large size recording sheets 30.

The paper tray 2 is configured to load recording sheets 30 and is attachable to and detachable from the image forming apparatus 1.

The output tray 3 is configured to receive the recording sheet 30 having an image recorded thereon.

The ink cartridge holder 14 is configured to hold the ink cartridges 20*k*, 20*c*, 20*m*, and 20*y*. The ink cartridge holder 14 is disposed on one end of the front 13 in a direction perpendicular to a recording sheet conveyance direction and beside the paper tray 2 and the output tray 3. The ink cartridge holder 14 protrudes from the front 13 and is disposed below the top cover 11.

The control panel 15 is configured to include buttons and indicators with which the operator operates the image forming apparatus 1. The control panel 15 is disposed on a top surface of the ink cartridge holder 14.

The front cover 16 is disposed on a front of the ink cartridge holder 14 to cover the front of the ink cartridge holder 14. The front cover 16 wholly includes a see-through portion, for example a transparent or a translucent member, through which the operator can visually check the ink cartridges 20*k*, 20*c*, 20*m*, and 20*y* placed in the ink cartridge holder 14 while the front cover 16 is closed. The front cover 16 may partially include the transparent or the translucent member if the operator can visually check the ink cartridges 20*k*, 20*c*, 20*m*, and 20*y*.

The translucent member includes at least a substantially translucent section through which the operator can identify the ink cartridges 20*k*, 20*c*, 20*m*, and 20*y* placed in the ink cartridge holder 14. A surface of the translucent member may be tinted or roughened.

The ink cartridges 20*k*, 20*c*, 20*m*, and 20*y* are configured to contain ink in black, cyan, magenta, and yellow colors. As illustrated in FIG. 2, the ink cartridges 20*k*, 20*c*, 20*m*, and 20*y* are inserted from the front of the image forming apparatus 1 into the ink cartridge holder 14. The front cover 16 can be opened and closed to replace the ink cartridges 20*k*, 20*c*, 20*m*, and 20*y*. The ink cartridges 20*k*, 20*c*, 20*m*, and 20*y* are placed in a portrait orientation and are horizontally aligned in the ink cartridge holder 14.

The indicator 21*k* is configured to indicate that the ink cartridge 20*k* is almost empty or empty. The indicator 21*c* is configured to indicate that the ink cartridge 20*c* is almost empty or empty. The indicator 21*m* is configured to indicate that the ink cartridge 20*m* is almost empty or empty. The indicator 21*y* is configured to indicate that the ink cartridge 20*y* is almost empty or empty.

The tray 31 is configured to load the recording sheets 30. The tray cover 32 is configured to include a see-through portion, for example a transparent or a translucent member, covering a top of the tray 31. The window 33 is used to check a quantity of the recording sheets 30 loaded in the tray 31. The support 34 is configured to support the output tray 3. The ribs 35*a* and 35*b* are configured to prevent the recording sheets 30 from slipping off the output tray 3 and to cause the recording sheets 30 to be properly stacked on the output tray 3.

Figure 3:
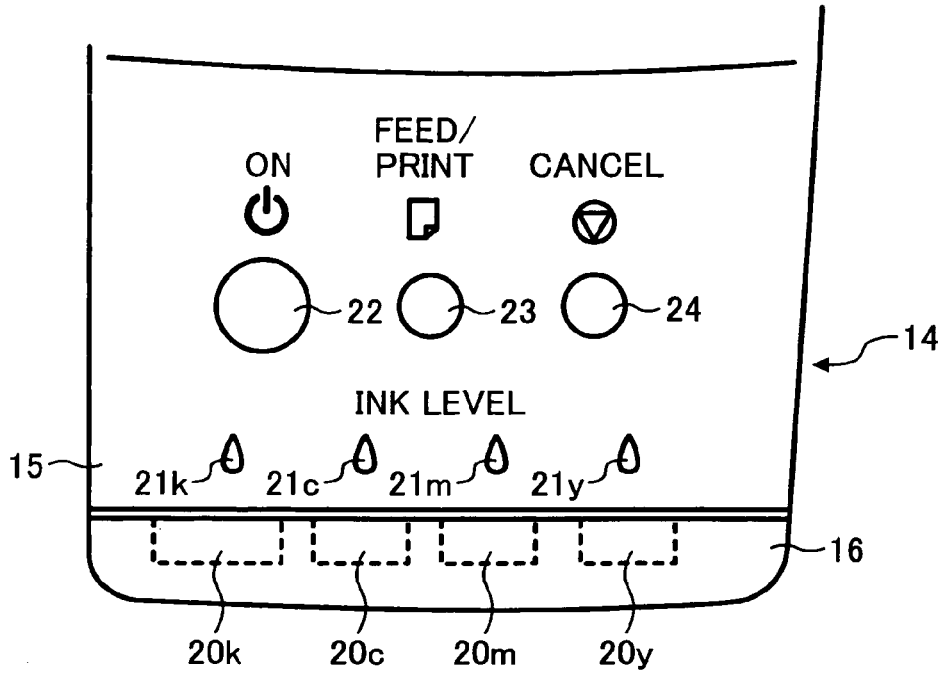
FIG. 3 is a top view of an ink cartridge holder of the image forming apparatus shown in FIG. 1.

As illustrated in FIG. 3, the control panel 15 further includes a power-on button 22, a feed/print button 23, and a cancel button 24.

The power-on button 22 is pressed to start the image forming apparatus 1. The feed/print button 23 is pressed to feed the recording sheet 30 or to resume printing after printing is interrupted. The cancel button 24 is pressed to cancel printing.

The control panel 15 further includes character strings showing functions of the power-on button 22, the feed/print button 23, the cancel button 24, and the indicators 21*k*, 21*c*, 21*m*, and 21*y*, such as "On" and "Ink Level".

The indicator 21*k* is disposed at a position on the control panel 15 corresponding to a position in the ink cartridge holder 14 where the ink cartridge 20*k* is placed. The indicator 21*c* is disposed at a position on the control panel 15 corresponding to a position in the ink cartridge holder 14 where the ink cartridge 20*c* is placed. The indicator 21*m* is disposed at a position on the control panel 15 corresponding to a position in the ink cartridge holder 14 where the ink cartridge 20*m* is placed. The indicator 21*y* is disposed at a position on the control panel 15 corresponding to a position in the ink cartridge holder 14 where the ink cartridge 20*y* is placed.

Each of the indicators 21*k*, 21*c*, 21*m*, and 21*y* includes an LED (light-emitting diode). The LED emits a light in a color common to the color of ink in the corresponding ink cartridge 20*k*, 20*c*, 20*m*, or 20*y*, for example. When the ink cartridge 20*k*, 20*c*, 20*m*, or 20*y* is almost empty, the indicator 21*k*, 21*c*, 21*m*, or 21*y* flashes. When the ink cartridge 20*k*, 20*c*, 20*m*, or 20*y* is empty, the indicator 21*k*, 21*c*, 21*m*, or 21*y* lights, for example. Each of the indicators 21*k*, 21*c*, 21*m*, and 21*y* includes a plane liquid drop shape or a plane teardrop shape. Thus, the operator can recognize that the indicators 21*k*, 21*c*, 21*m*, and 21*y* relate to ink.

As described above, the front cover 16 wholly or partially includes the transparent or the translucent member through which the operator can visually check the ink cartridges 20*k*, 20*c*, 20*m*, and 20*y* placed in the ink cartridge holder 14 while the front cover 16 is closed. Thus, the operator can identify the ink cartridges 20*k*, 20*c*, 20*m*, and 20*y* while the front cover 16 is closed.

The operator can easily check the indicators 21*k*, 21*c*, 21*m*, and 21*y* and the ink cartridges 20*k*, 20*c*, 20*m*, and 20*y* corresponding to the indicators 21*k*, 21*c*, 21*m*, and 21*y*. Thus the indicators 21*k*, 21*c*, 21*m*, and 21*y* and the ink cartridges 20*k*, 20*c*, 20*m*, and 20*y* serve as improved user interfaces. A survey conducted by inventors of the present invention revealed that when the front cover 16 includes an opaque member and the operator cannot visually check the ink cartridges 20*k*, 20*c*, 20*m*, and 20*y* while the front cover 16 is closed, the operator may not recognize that the ink cartridge 20*k*, 20*c*, 20*m*, or 20*y* needs to be replaced even when the indicator 21*k*, 21*c*, 21*m*, or 21*y* flashes or lights. According to the present embodiment, the operator can visually check the indicators 21*k*, 21*c*, 21*m*, and 21*y* and the ink cartridges 20*k*, 20*c*, 20*m*, and 20*y* corresponding to the indicators 21*k*, 21*c*, 21*m*, and 21*y*. Thus, the image forming apparatus 1 provides an improved user-friendliness.

A structure of the indicators 21*k*, 21*c*, 21*m*, and 21*y* is not limited to the structure described above.

Figure 4:
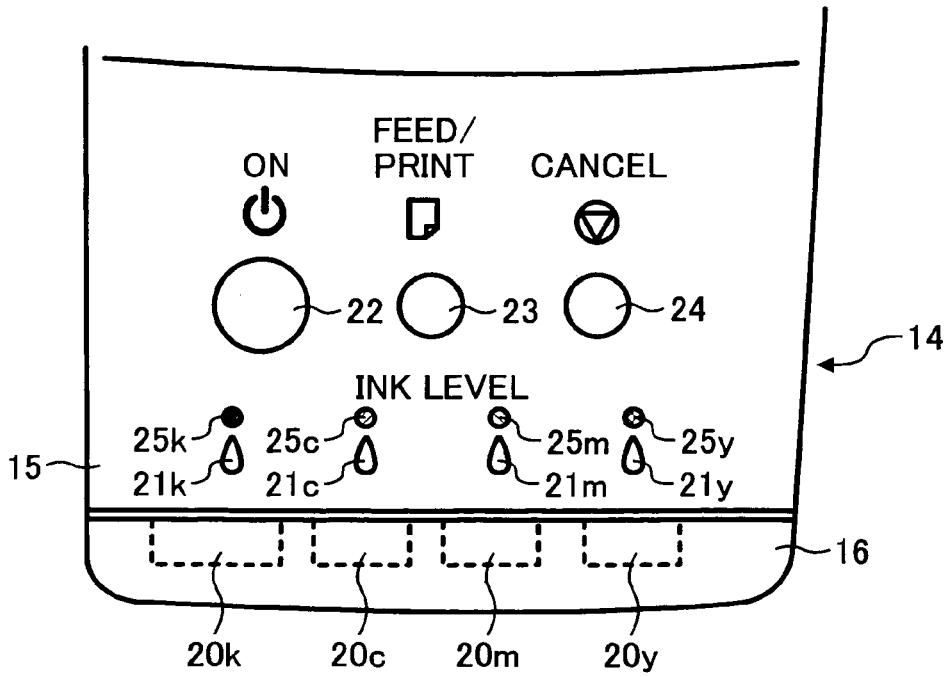
FIG. 4 is a top view of another ink cartridge holder of the image forming apparatus shown in FIG. 1.

As illustrated in FIG. 4, the control panel 15 may further include indexes 25*k*, 25*c*, 25*m*, and 25*y*. The index 25*k* is configured to show a color corresponding to the indicator 21*k*. The index 25*c* is configured to show a color corresponding to the indicator 21*c*. The index 25*m* is configured to show a color corresponding to the indicator 21*m*. The index 25*y* is configured to show a color corresponding to the indicator 21*y*.

Figure 5:
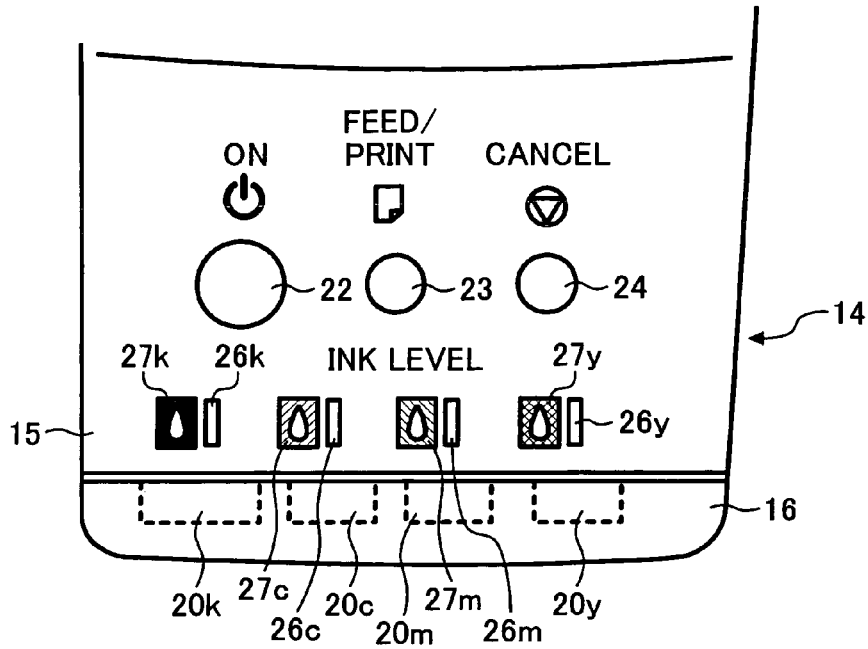
FIG. 5 is a top view of yet another ink cartridge holder of the image forming apparatus shown in FIG. 1.

As illustrated in FIG. 5, the control panel 15 may include indicators 26*k*, 26*c*, 26*m*, and 26*y* and indexes 27*k*, 27*c*, 27*m*, and 27*y* instead of the indicators 21*k*, 21*c*, 21*m*, and 21*y*. The indicators 26*k*, 26*c*, 26*m*, and 26*y* are configured to emit a common color. The index 27*k* is configured to correspond to the indicator 26*k* and outline a liquid drop shape on a background painted in a color corresponding to the color of ink in the ink cartridge 20*k*. The index 27*c* is configured to correspond to the indicator 26*c* and outline a liquid drop shape on a background painted in a color corresponding to the color of ink in the ink cartridge 20*c*. The index 27*m* is configured to correspond to the indicator 26*m* and outline a liquid drop shape on a background painted in a color corresponding to the color of ink in the ink cartridge 20*m*. The index 27*y* is configured to correspond to the indicator 26*y* and outline a liquid drop shape on a background painted in a color corresponding to the color of ink in the ink cartridge 20*y*.

The image forming apparatus 1 includes the paper tray 2 and the output tray 3 separated from each other. The image forming apparatus 1 can handle the recording sheet 30 of A3 size.

Figure 6:
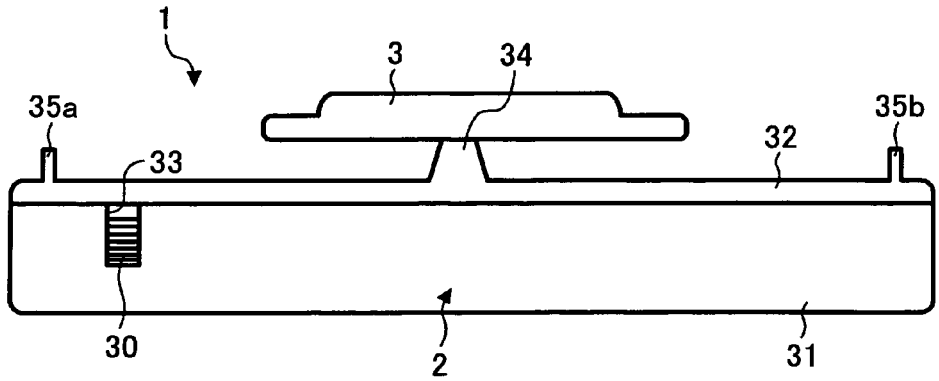
FIG. 6 is a front view of a paper tray and an output tray of the image forming apparatus shown in FIG. 1.
Figure 7:
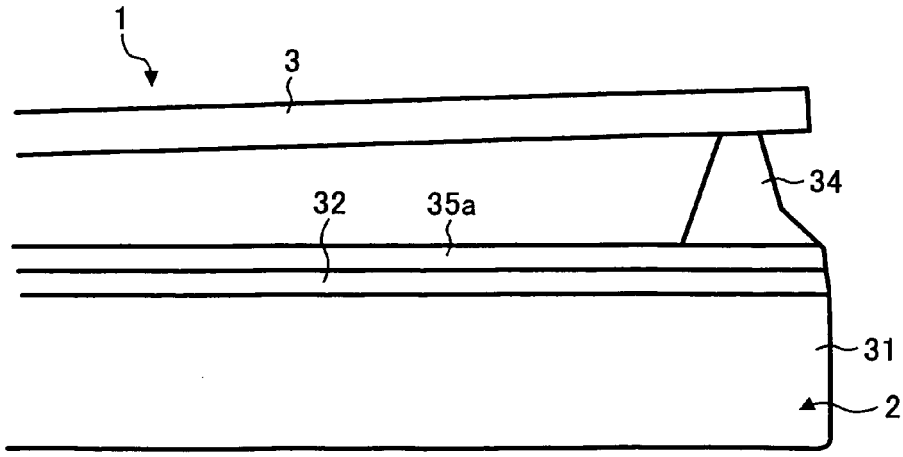
FIG. 7 is a side view of the paper tray and the output tray shown in FIG. 6.

As illustrated in FIGS. 6 and 7, the paper tray 2 includes the tray 31 and the tray cover 32. The window 33 is disposed on a front of the tray 31. Thus, the operator can check the quantity of the recording sheets 30 loaded in the tray 31 through the window 33, when the image forming apparatus 1 is placed on a flat surface as well as when the image forming apparatus 1 is placed on a rack and the operator cannot check the quantity of the recording sheets 30 through the tray cover 32. This results in providing an improved user-friendliness.

The support 34 is disposed on a center of the tray cover 32 in the direction perpendicular to the recording sheet conveyance direction and along a front edge of the tray cover 32. The support 34 supports the output tray 3 at a surface of the output tray 3 facing the tray cover 32. Thus, the output tray 3 properly receives the recording sheets 30 of large size such as A3 size, and the recording sheets 30 are properly stacked on the output tray 3.

When a large number of ink drops are attached to the recording sheet 30, a weight of the recording sheet 30 substantially increases. The increased weight warps a foremost portion of the output tray 3 in the recording sheet conveyance direction, when the recording sheets 30 are stacked on the output tray 3. Thus, the recording sheets 30 may not be properly stacked on the output tray 3. To avoid this, the support 34 supports the foremost portion of the output tray 3 to prevent the output tray 3 from warping.

The ribs 35*a* and 35*b* are disposed on both sides of the tray cover 32 in the direction perpendicular to the recording sheet conveyance direction and along the recording sheet conveyance direction. Thus, the output tray 3 properly receives the recording sheets 30 of large size such as A3 size, and the recording sheets 30 are properly stacked on the output tray 3.

Figure 8:
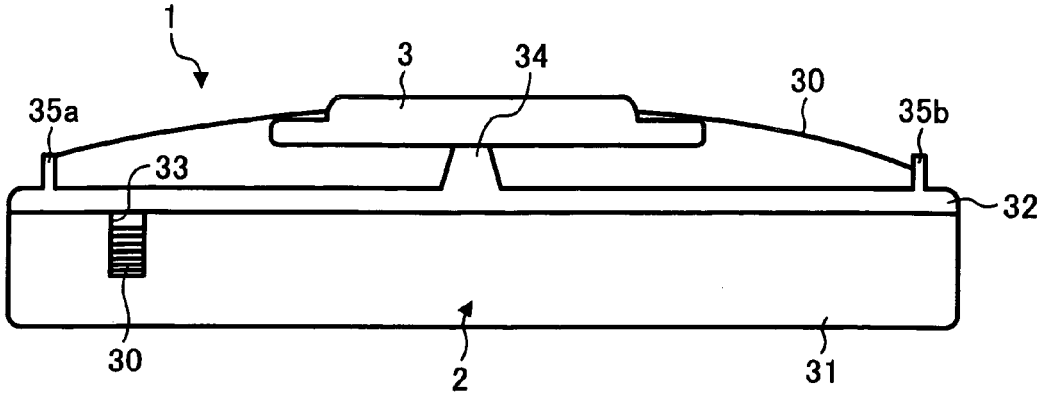
FIG. 8 is a front view of the paper tray and the output tray shown in FIG. 6 receiving a recording sheet.

If the output tray 3 and the paper tray 2 have a same width in the direction perpendicular to the recording sheet conveyance direction, the output tray 3 receives the recording sheet 30 in a state that the output tray 3 supports a full width of the recording sheet 30 in the direction perpendicular to the recording sheet conveyance direction. To prevent the recording sheet 30 having the ink drops attached thereto from curling, the output tray 3 preferably has a width in the direction perpendicular to the recording sheet conveyance direction shorter than the width of the paper tray 2. Thus, as illustrated in FIG. 8, both end portions in the direction perpendicular to the recording sheet conveyance direction of the recording sheet 30 received by the output tray 3 are not supported by the output tray 3. When the recording sheets 30 are stacked on the output tray 3, the recording sheets 30 may not be aligned on the output tray 3.

As illustrated in FIG. 8, the ribs 35*a* and 35*b* disposed on the tray cover 32 prevent the recording sheet 30 from shifting in the direction perpendicular to the recording sheet conveyance direction, even when the both end portions of the recording sheet 30 received by the output tray 3 warp downward. Thus, the recording sheets 30 are properly stacked on the output tray 3.

Figure 9:
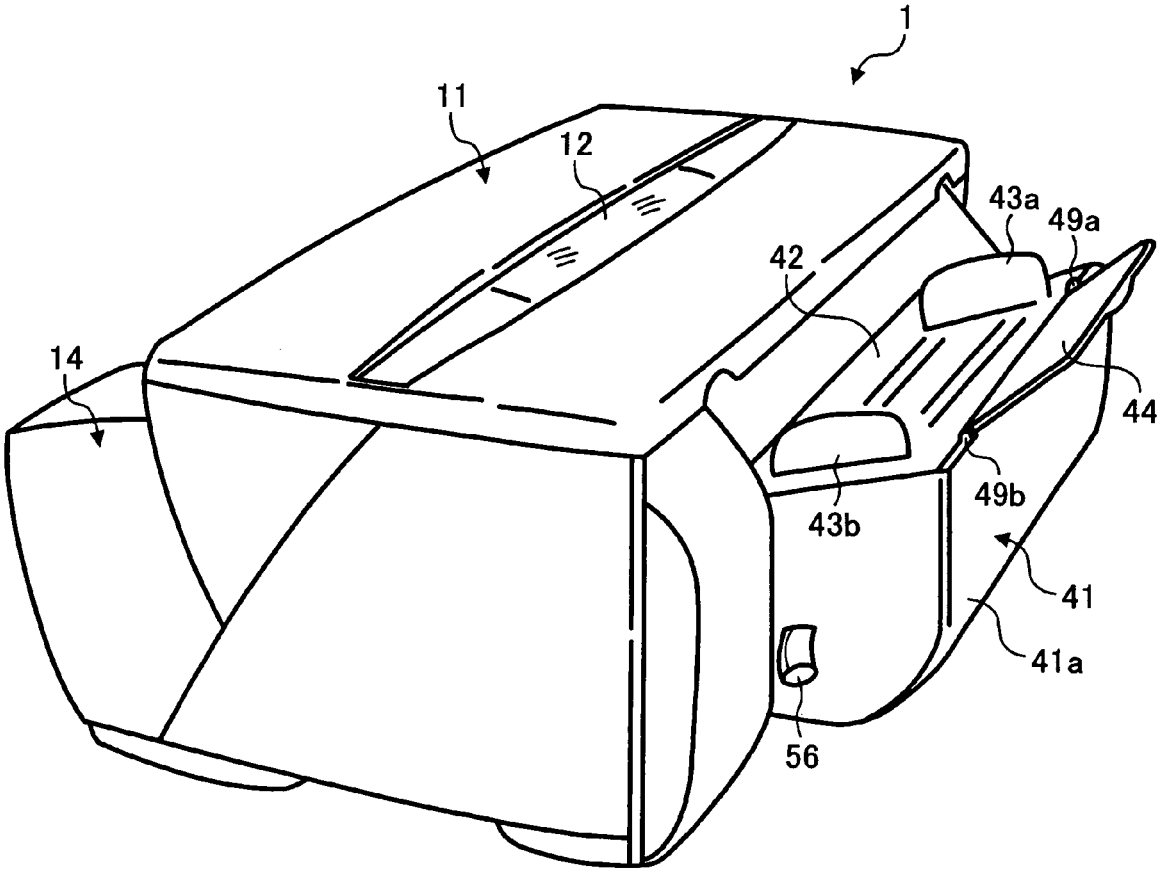
FIG. 9 is a back perspective view of the image forming apparatus shown in FIG. 1.

As illustrated in FIG. 9, the image forming apparatus 1 can further include a duplex unit 41. The duplex unit 41 includes a back cover 41*a*, a bypass tray 42, side guides 43*a* and 43*b*, an extension 44, supports 49*a* and 49*b*, and a knob 56.

The duplex unit 41 is configured to produce a duplex print. The duplex unit 41 is attached to a back of the image forming apparatus 1 and is attachable to and detachable from the image forming apparatus 1.

The back cover 41*a* is configured to cover the duplex unit 41 and store the extension 44.

The bypass tray 42 is configured to have a custom size sheet such as a postcard or a special sheet such as an OHP (overhead projector) transparency placed thereon. The bypass tray 42 is disposed on a top surface of the duplex unit 41.

The side guides 43*a* and 43*b* are configured to guide the sheet and are disposed on both ends of the bypass tray 42 in a direction perpendicular to a sheet conveyance direction. The side guides 43*a* and 43*b* can be moved in the direction perpendicular to the sheet conveyance direction to fit with a width of the sheet in the direction perpendicular to the sheet conveyance direction.

The extension 44 is configured to extend from the bypass tray 42 to support the sheet placed thereon. The extension 44 is disposed on an edge of the bypass tray 42, which is perpendicular to the sheet conveyance direction and opposes the top cover 11.

The supports 49*a* and 49*b* are configured to support the extension 44 when the extension 44 is tilted. The knob 56 is moved by the operator to attach and detach the duplex unit 41 to and from the image forming apparatus 1.

Figure 10:
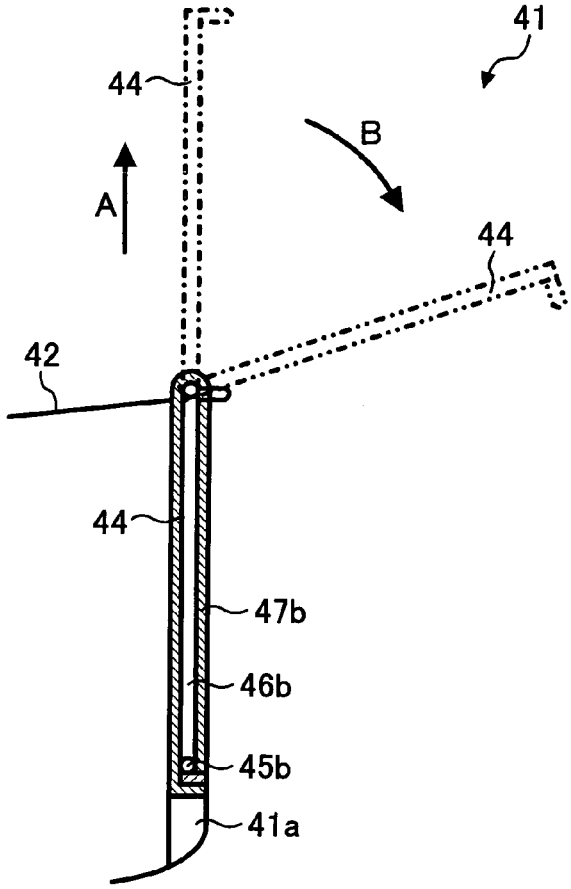
FIG. 10 is a side view of a duplex unit of the image forming apparatus shown in FIG. 9.

FIG. 10 illustrates one of both sides of the duplex unit 41 in the direction perpendicular to the sheet conveyance direction. As illustrated in FIG. 10, the duplex unit 41 further includes a pin 45*b*, a groove 46*b*, and a guide 47*b*.

Figure 11:
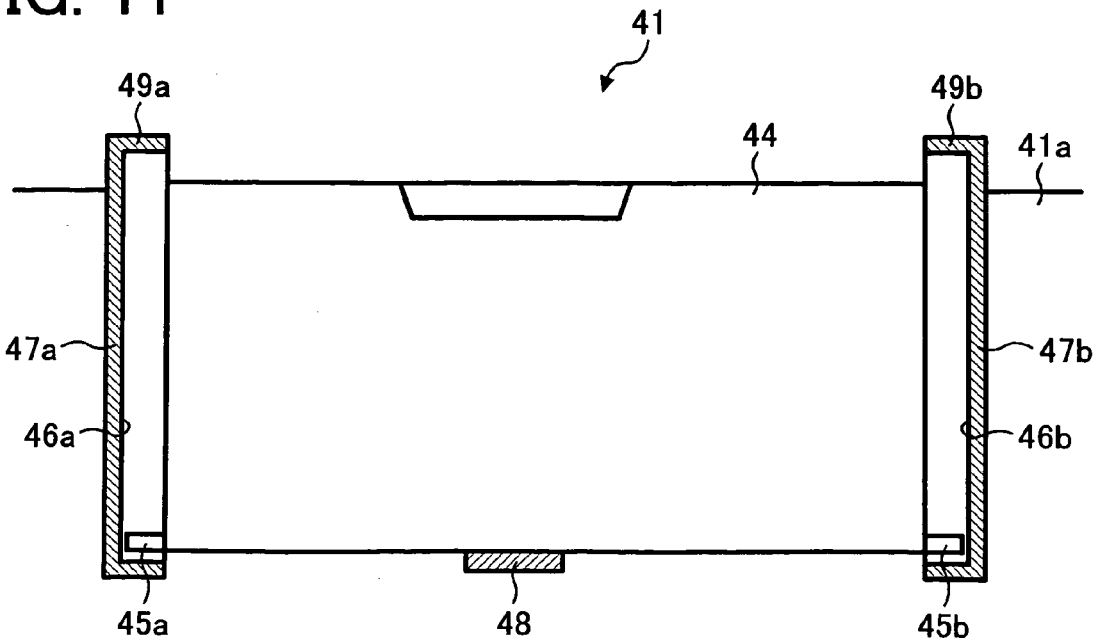
FIG. 11 is an internal view of the duplex unit shown in FIG. 10.

FIG. 11 illustrates the extension 44 stored in the duplex unit 41. As illustrated in FIG. 11, the duplex unit 41 further includes a pin 45*a*, a groove 46*a*, a guide 47*a*, and a stopper 48.

The extension 44 is stored upright inside the back cover 41*a* in the duplex unit 41. The pin 45*a* protrudes from a bottom of one side edge of the extension 44 in the direction perpendicular to the sheet conveyance direction and is configured to move in the groove 46*a*. The pin 45*b* protrudes from a bottom of another side edge of the extension 44 in the direction perpendicular to the sheet conveyance direction and is configured to move in the groove 46*b*. The guides 47*a* and 47*b* are disposed on the back cover 41*a*. The guide 47*a* forms the groove 46*a* configured to guide the pin 45*a*. The guide 47*b* forms the groove 46*b* configured to guide the pin 45*b*. The stopper 48 is configured to stop the extension 44 moving downward to be stored. The stopper 48 supports a bottom of the extension 44 when the extension 44 is stored in the duplex unit 41. The supports 49*a* and 49*b* are respectively disposed on tops of the guides 47*a* and 47*b* and are integrally molded with the back cover 41*a*.

As illustrated in FIG. 10, the extension 44 is pulled up in a direction A from the duplex unit 41 to a position indicated by alternate long and short dashed lines. When the pins 45*a* and 45*b* respectively knock ceilings of the grooves 46*a* and 46*b* in the supports 49*a* and 49*b*, the extension 44 is turned in a direction B to a position indicated by a chain double-dashed line. Thus, the extension 44 extends a top surface of the bypass tray 42.

Even if the bypass tray 42 alone does not provide enough length in the sheet conveyance direction, the bypass tray 42 and the extension 44 extended from the bypass tray 42 provide enough length for placing the sheet.

Figure 12:
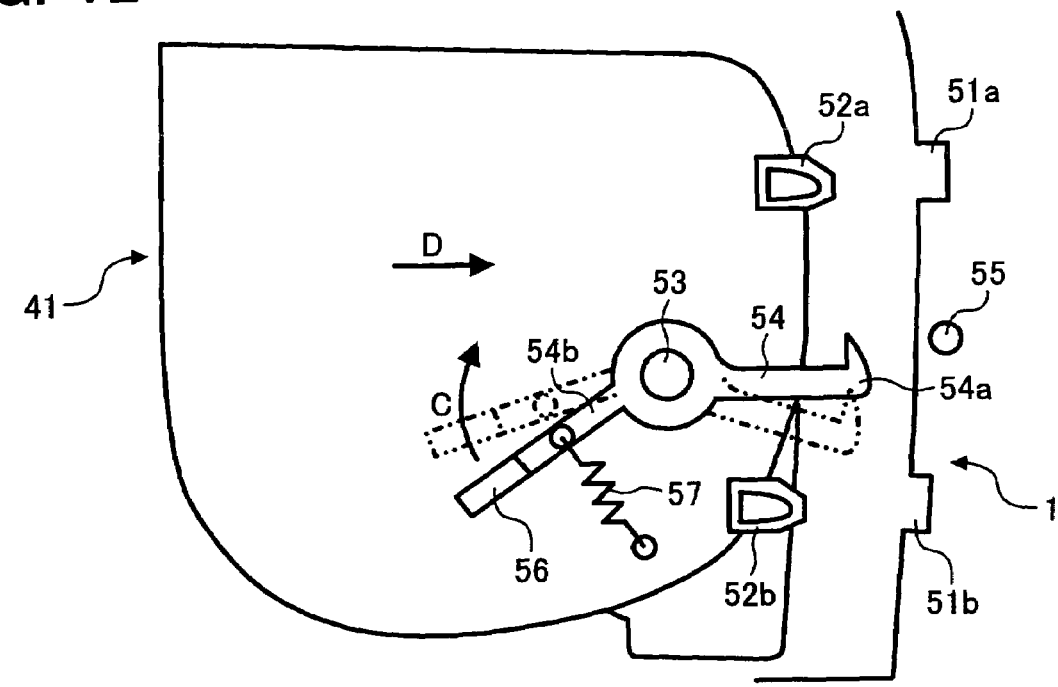
FIG. 12 is a side view of a mechanism of the duplex unit before the duplex unit is attached to the image forming apparatus shown in FIG. 9.
Figure 13:
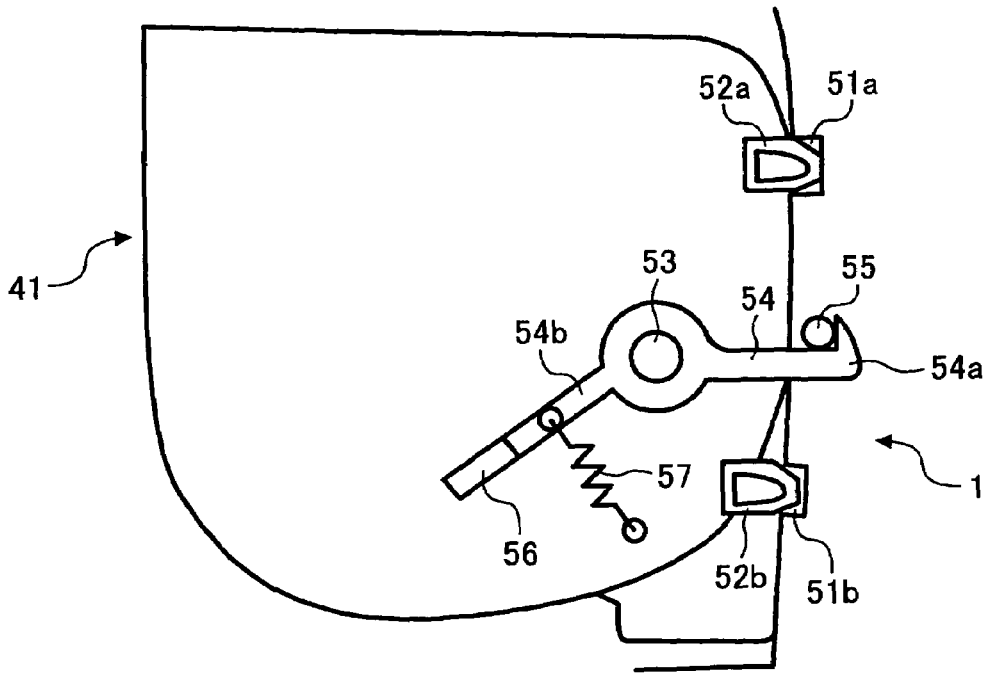
FIG. 13 is a side view of the mechanism of the duplex unit after the duplex unit is attached to the image forming apparatus shown in FIG. 9.

As illustrated in FIGS. 12 and 13, the image forming apparatus 1 further includes notches 51*a* and 51*b* and a pin 55. The duplex unit 41 further includes bosses 52*a* and 52*b*, a support axis 53, a lever 54, and a spring 57. The lever 54 includes a head portion 54*a* and a tail portion 54*b*.

The tail portion 54*b* includes the knob 56.

The notches 51*a* and 51*b* are configured to position the duplex unit 41 attached to the image forming apparatus 1. The notches 51*a* and 51*b* are disposed on the image forming apparatus 1 and are vertically aligned. The pin 55 is configured to engage with the head portion 54*a*. The bosses 52*a* and 52*b* are disposed on the duplex unit 41 and are vertically aligned. The bosses 52*a* and 52*b* are inserted into the notches 51*a* and 51*b*. Thus, the duplex unit 41 is positioned against the image forming apparatus 1. The support axis 53 is configured to rotatably support the lever 54. The lever 54 is configured to have a force applied thereto to attach and detach the duplex unit 41 to and from the image forming apparatus 1. The spring 57 is configured to apply a force to the lever 54 to engage the head portion 54*a* with the pin 55. The spring 57 is disposed between the tail portion 54*b* and a fixed portion (not shown). The head portion 54*a* is configured to engage with the pin 55. The tail portion 54*b* is configured to have the spring 57 attached thereto.

The operator moves up the knob 56 to attach and detach the duplex unit 41 to and from the image forming apparatus 1. While the knob 56 is moved up in a direction C to a position indicated by a chain double-dashed line illustrated in FIG. 12, the duplex unit 41 is pushed in a direction D. The bosses 52*a* and 52*b* are inserted into the notches 51*a* and 51*b* to position the duplex unit 41 against the image forming apparatus 1. The moving up of the knob 56 is cleared so that a resilience of the spring 57 causes the head portion 54*a* to engage with the pin 55 as illustrated in FIG. 13. Thus, the duplex unit 41 is attached to the image forming apparatus 1.

Figure 14:
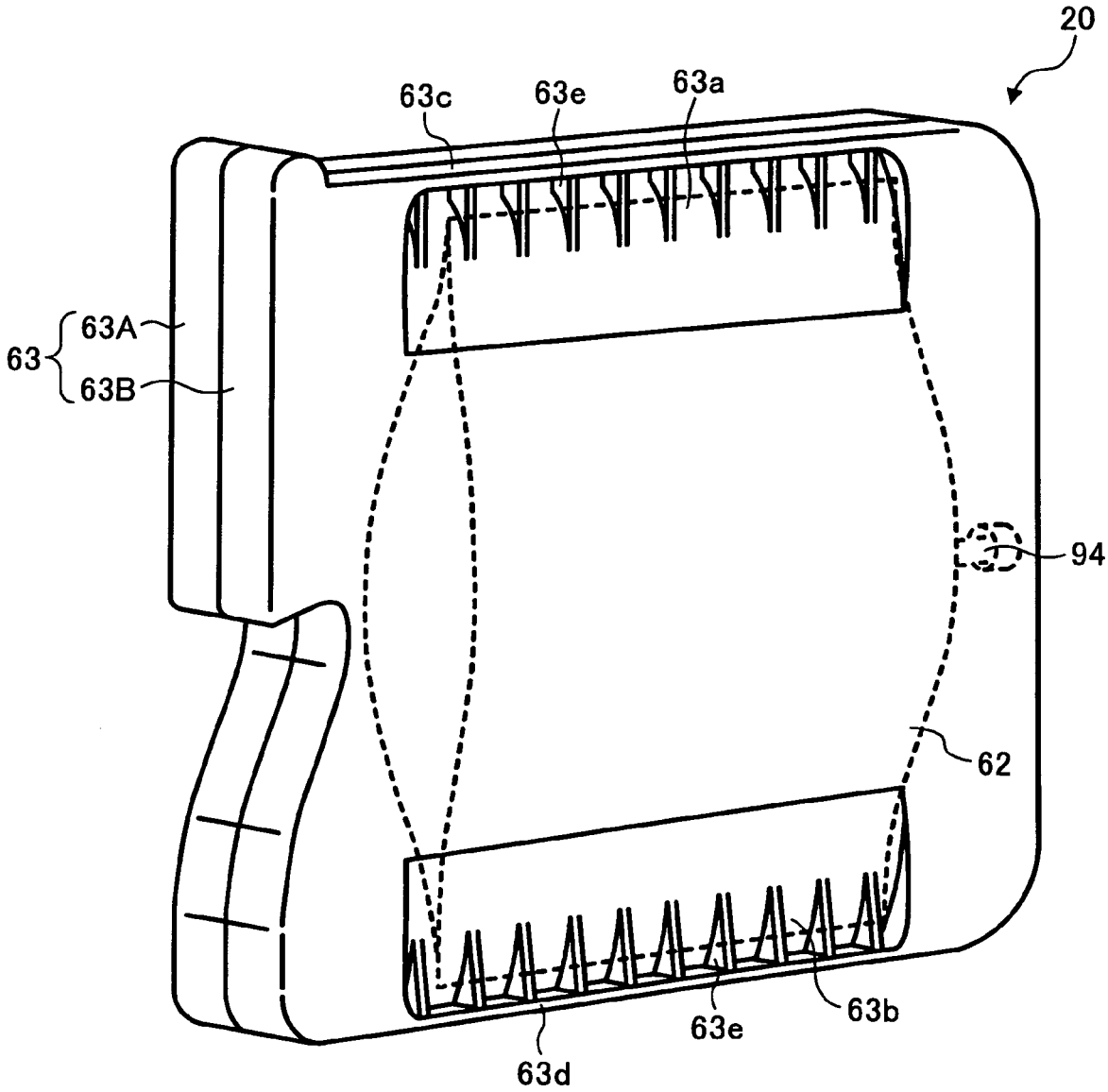
FIG. 14 is a perspective view of an ink cartridge of the image forming apparatus shown in FIG. 9.

As illustrated in FIG. 14, the ink cartridge 20 includes an ink bag 62 and a case 63. The ink bag 62 includes an ink outlet 94. The case 63 includes a first case 63A and a second case 63B. Each of the first case 63A and the second case 63B includes a round portion 63*a*, a round portion 63*b*, a top wall 63*c*, a bottom wall 63*d*, and ribs 63*e*.

The ink bag 62 is configured to contain ink. The ink outlet 94 is configured to discharge ink. The case 63 is configured to hold the ink bag 62 and can be divided into at least two parts, the first case 63A and the second case 63B, in a direction parallel to an ink discharging direction. The first case 63A is configured to form one half of the case 63 to protect the ink bag 62. The second case 63B is configured to form the other half of the case 63 to protect the ink bag 62. The round portion 63*a* is configured to fit with a shape of a top portion of the ink bag 62. The round portion 63*b* is configured to fit with a shape of a bottom portion of the ink bag 62. The top wall 63*c* is configured to form a top of the first case 63A and the second case 63B. The bottom wall 63*d* is configured to form a bottom of the first case 63A and the second case 63B. The ribs 63*e* are configured to strengthen the top wall 63*c* and the bottom wall 63*d*.

Figure 15:
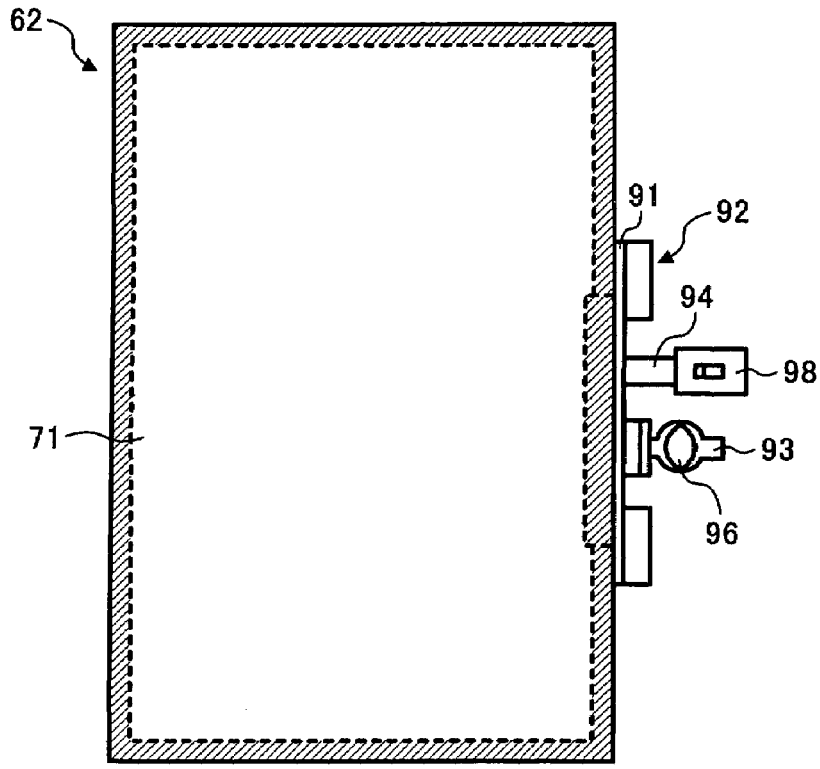
FIG. 15 is a side view of an ink bag of the ink cartridge shown in FIG. 14.

As illustrated in FIG. 15, the ink bag 62 includes a bag 71, a holder 92, an ink inlet 93, a seal 96, an ink outlet 94, and a cap 98.

The holder 92 includes a flange 91.

The bag 71 is configured to contain ink. The holder 92 is configured to hold the bag 71 and includes the flange 91 sandwiched between the first case 63A and the second case 63B. The flange 91 is configured to hold the ink inlets 93 and 94. The flange 91 is integrally molded with the ink inlets 93 and 94. Each of the ink inlets 93 and 94 includes a hollow. After ink is charged into the bag 71 through the ink inlet 93, the ink inlet 93 is heat-sealed. The ink inlet 93 is configured to form an inlet through which ink is charged. The seal 96 is configured to seal the ink inlet 93 after ink is charged and indicates a heat-sealed portion. The ink outlet 94 is configured to form an outlet through which ink is discharged and includes a hole penetrating the flange 91. An elastic member is inserted into the hole to seal the hole. The cap 98 is configured to cap the ink outlet 94 through which ink is discharged. The cap 98 holds the elastic member inserted into the hole of the ink discharging outlet 94 and caps a head of the ink outlet 94.

Figure 16:
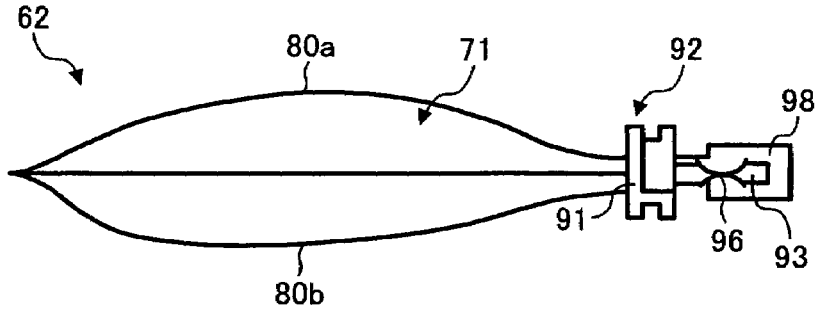
FIG. 16 is a bottom view of the ink bag shown in FIG. 15.

As illustrated in FIG. 16, the ink bag 62 further includes two aluminum laminated films 80*a* and 80*b*.

The aluminum laminated films 80*a* and 80*b* are configured to be bendable and form the bag 71.

Figure 17:
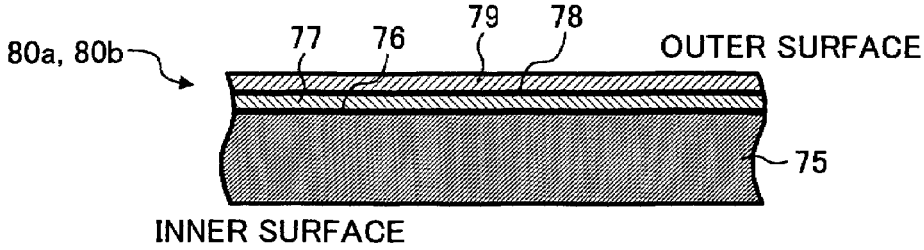
FIG. 17 is a cross-sectional view of an aluminum laminated film of the ink bag shown in FIG. 15.

As illustrated in FIG. 17, each of the aluminum laminated films 80*a* and 80*b* includes an LDPE (low density polyethylene) layer 75, a dry-laminated layer 76, an aluminum layer 77, a dry-laminated layer 78, and a PA (polyamide) layer 79.

The dry-laminated layer 76 is formed on the LDPE layer 75. The aluminum layer 77 is formed on the dry-laminated layer 76. The dry-laminated layer 78 is formed on the aluminum layer 77. The PA layer 79 is formed on the dry-laminated layer 78.

As illustrated in FIG. 15, the bag 71 is formed in a rectangle-like shape, according to the present embodiment. The holder 92 includes a resin. The holder 92 is adhered to one side of a rectangle of the bag 71.

Four edges of the rectangle of the aluminum laminated film 80*a* are attached to corresponding four edges of the rectangle of the aluminum laminated film 80*b*. The four edges are shaded in FIG. 15.

Figure 18:
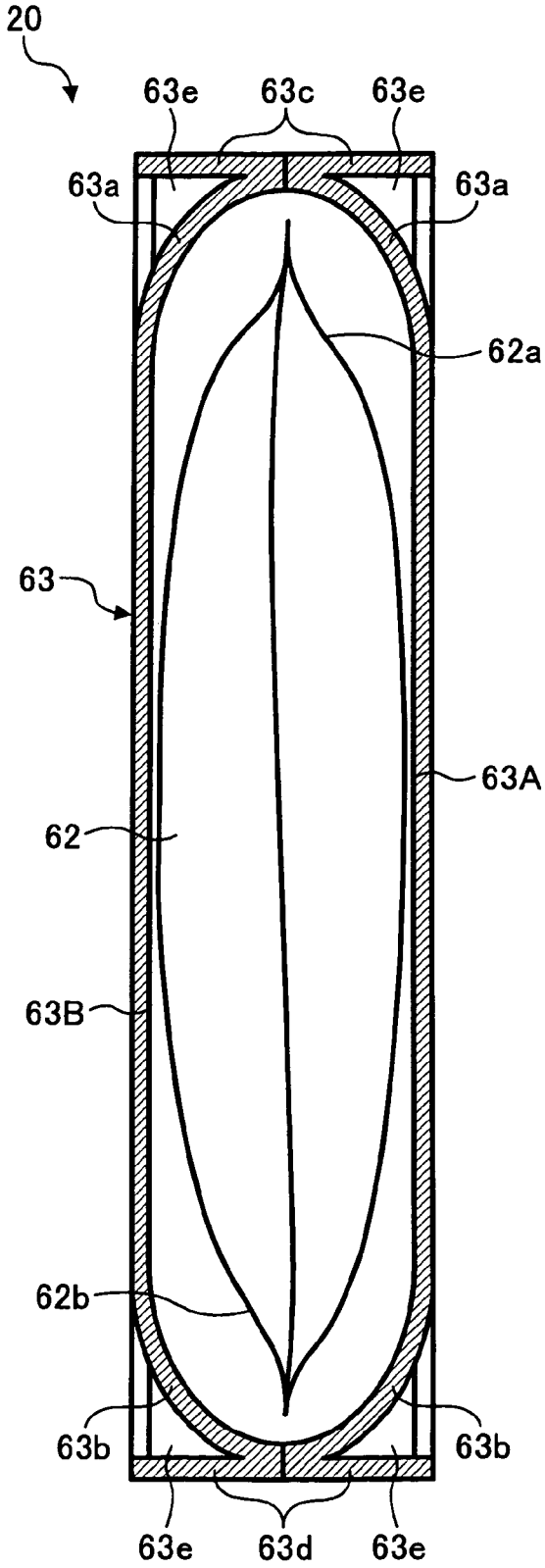
FIG. 18 is a cross-sectional view of the ink cartridge shown in FIG. 14.

As illustrated in FIG. 18, the ink cartridge 20 further includes a top portion 62*a* and a bottom portion 62*b*.

The top portion 62*a* is formed by edges of the adhered aluminum laminated films 80*a* and 80*b*. The bottom portion 62*b* is formed by other edges of the adhered aluminum laminated films 80*a* and 80*b*. When the ink bag 62 is filled with ink, the ink bag 62 in cross section expands from the top portion 62*a* and the bottom portion 62*b* and is not formed in a rectangular shape.

The first case 63A and the second case 63B respectively include the round portions 63*a* in top portions of the first case 63A and the second case 63B. The first case 63A and the second case 63B respectively include the round portions 63*b* in bottom portions of the first case 63A and the second case 63B. Each of the round portions 63*a* and 63*b* includes a circular shape or an arc-like shape in cross section. Thus, each of the round portions 63*a* and 63*b* fits with an outer shape of the ink bag 62 near the top portion 62*a* and the bottom portion 62*b*.

A plurality of the ribs 63*e* are formed between an outer surface of the round portion 63*a* and the top wall 63*c* and between an outer surface of the round portion 63*b* and the bottom wall 63*d*.

Even when the ink bag 62 swings and hits inner surfaces of the first case 63A and the second case 63B while the ink cartridge 20 is transported, the above structure of the ink cartridge 20 can prevent the aluminum laminated films 80*a* and 80*b* from being broken.

Figure 19:
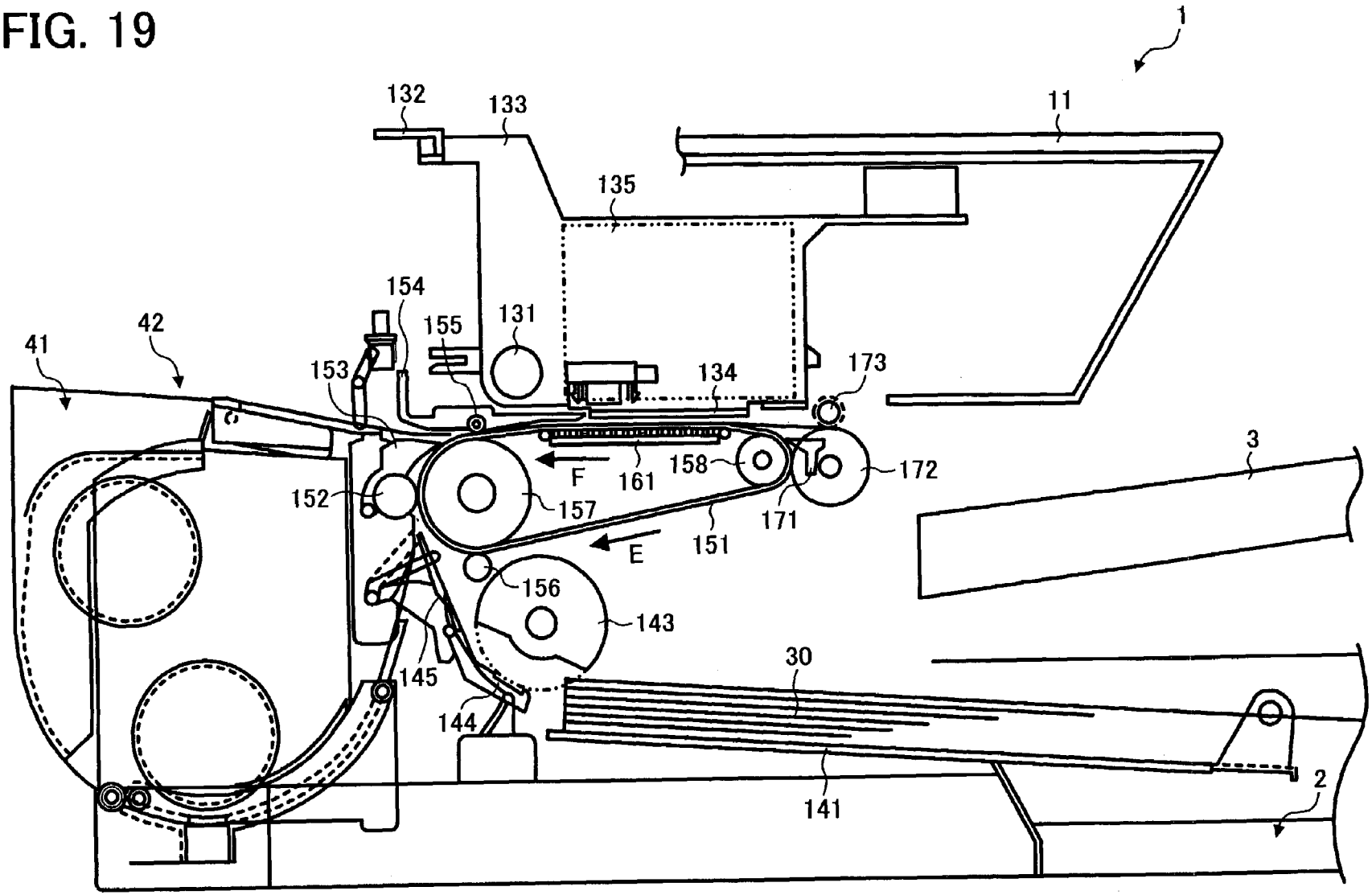
FIG. 19 is a cross-sectional view of the image forming apparatus shown in FIG. 9.

As illustrated in FIG. 19, the image forming apparatus 1 further includes a guide rod 131, a stay 132, a carriage 133, recording heads 134, a sub tank 135, a loading tray 141, a feeding roller 143, a separation pad 144, a guide 145, a transfer belt 151, a counter roller 152, a transfer guide 153, a pressing member 154, a pressing roller 155, a charging roller 156, a transfer roller 157, a tension roller 158, a guide member 161, a separation pawl 171, and separation rollers 172 and 173.

The loading tray 141 is configured to load the recording sheets 30 and is included in the paper tray 2. The feeding roller 143 is configured to feed the recording sheets 30 loaded on the loading tray 141. The separation pad 144 is configured to separate the fed recording sheets 30 one by one. The separation pad 144 faces the feeding roller 143 and applies pressure to the feeding roller 143. The separation pad 144 includes a material having a large friction coefficient. The guide 145 is configured to guide the separated recording sheet 30 to the transfer belt 151. The guided recording sheet 30 is conveyed between the transfer belt 151 and the counter roller 152. The transfer guide 153 turns the vertically conveyed recording sheet 30 by about 90 degrees so that the turned recording sheet 30 is conveyed on the transfer belt 151.

The transfer belt 151 is configured to electrostatically attract and transfer the guided recording sheet 30. The transfer belt 151 is formed in an endless belt shape, laid across the transfer roller 157 and the tension roller 158, and rotates in a direction E. The transfer belt 151 includes a front layer and a back layer. The front layer includes a resin material such as an ETFE (ethylene-tetrafluoroethylene) pure material. The resin material is not resistance-controlled and has a thickness of about 40 μm. The front layer attracts the recording sheet 30. The back layer includes the resin material and is resistance-controlled with carbon. The back layer functions as a medium-resistance layer or a grounded layer.

The counter roller 152 is configured to sandwich the transferred recording sheet 30 together with the transfer belt 151 and transfer the recording sheet 30 to the transfer guide 153. The transfer guide 153 is configured to turn and guide the transferred recording sheet 30 onto the transfer belt 151. The pressing member 154 is configured to apply pressure to the pressing roller 155. The pressing roller 155 is configured to apply pressure to the guided recording sheet 30.

The charging roller 156 is configured to charge an outer circumferential surface of the transfer belt 151. The charging roller 156 contacts the front layer of the transfer belt 151 and is disposed to rotate in accordance with rotation of the transfer belt 151. A pressure of about 2.5 N is applied to each of both ends of a shaft of the charging roller 156.

The transfer roller 157 and the tension roller 158 are configured to support the transfer belt 151. The transfer roller 157 is disposed to contact the back layer of the transfer belt 151 and is grounded to function as a grounded roller.

The guide member 161 is configured to push up a print area on the transfer belt 151. The guide member 161 is disposed to contact a portion on an inner circumferential surface of the transfer belt 151. The portion corresponds to the print area onto which the recording heads 134 eject ink drops. A line formed by a top surface of the guide member 161 protrudes toward the recording heads 134 from an upper straight line formed by the transfer belt 151 between the transfer roller 157 and the tension roller 158. The guide member 161 pushes up the print area on the transfer belt 151. Thus, the print area on the transfer belt 151 keeps a flat surface thereon.

The guide rod 131 is configured to carry the carriage 133 in a manner that the carriage 133 slides in a main scanning direction. The stay 132 is configured to hold the carriage 133 in the manner that the carriage 133 slides in the main scanning direction.

The carriage 133 is configured to carry the four recording heads 134. Each of the recording heads 134 includes an inkjet head. Each inkjet head includes a nozzle. Nozzles are arranged in a sub-scanning direction to eject ink drops downward.

The inkjet head includes an energy generator for ejecting ink drops, such as a piezoelectric actuator, a thermal actuator, a shape-memory alloy actuator, or an electrostatic actuator. The piezoelectric actuator includes a piezoelectric element. The thermal actuator uses phase change caused by film boiling of liquid by using an electrothermal conversion element such as a heat generating resistance body. The shape-memory alloy actuator uses metal phase change caused by change in temperature. The electrostatic actuator uses an electrostatic force.

The recording heads 134 are configured to eject ink drops in the black, cyan, magenta, and yellow colors onto the recording sheet 30. The sub tanks 135 are configured to supply ink in the black, cyan, magenta, and yellow colors to the recording heads 134.

The separation pawl 171 is configured to separate the recording sheet 30 from the transfer belt 151.

The output rollers 172 and 173 are configured to feed the separated recording sheet 30 onto the output tray 3. The output tray 3 is disposed below the output roller 172. A certain space is secured between a position sandwiched by the output rollers 172 and 173 and a top surface of the output tray 3. Thus, the output tray 3 can receive a sufficient amount of the recording sheets 30.

For duplex printing, the transfer belt 151 rotates in a direction F after ink drops are ejected onto one side of the recording sheet 30 and conveys the recording sheet 30 into the duplex unit 41. In the duplex unit 41, the recording sheet 30 is reversed and fed between the transfer belt 151 and the counter roller 152 again.

Figure 20:
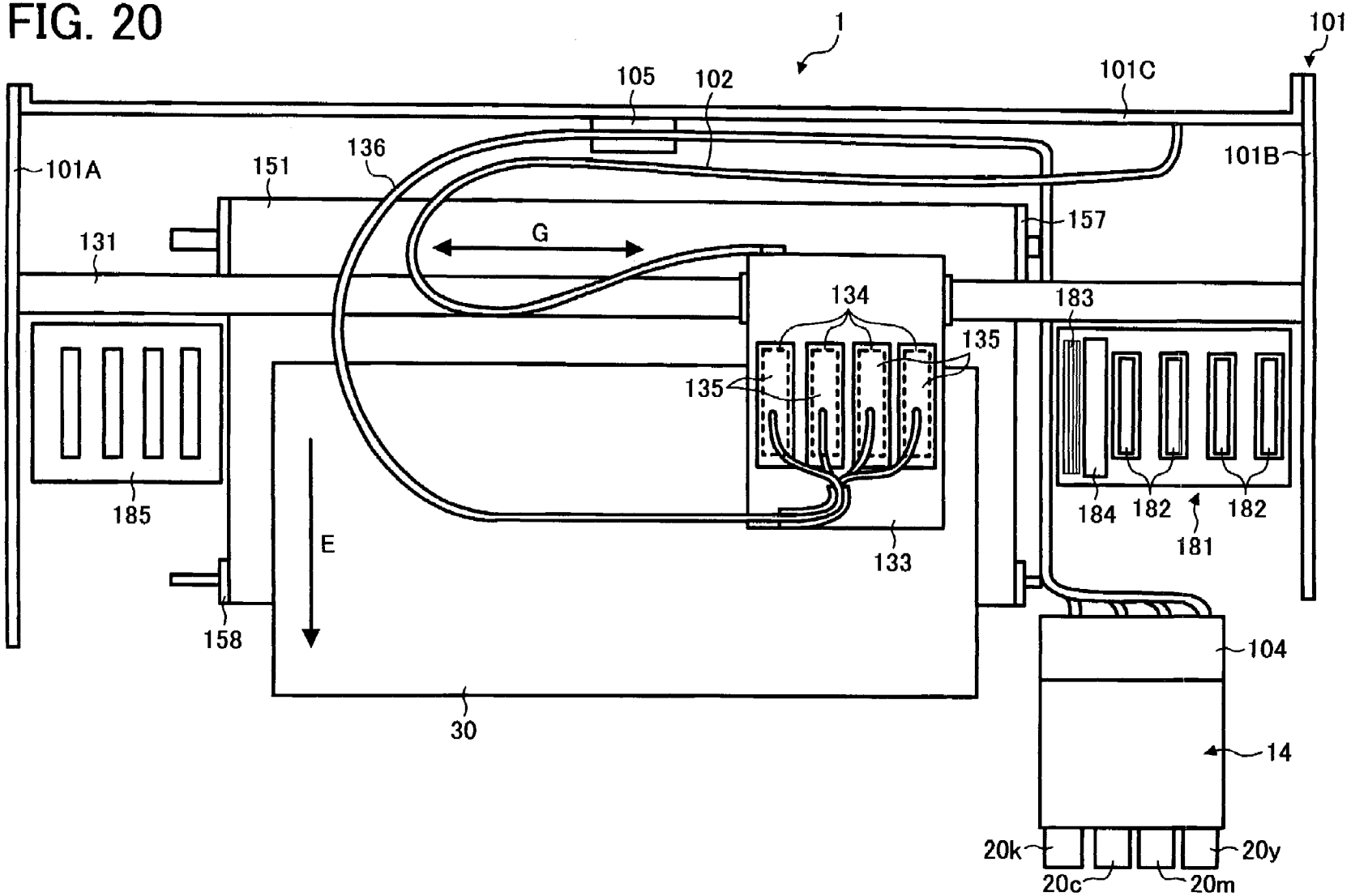
FIG. 20 is a plan view of the image forming apparatus shown in FIG. 9.

As illustrated in FIG. 20, the image forming apparatus 1 further includes a frame 101, a harness 102, a pump unit 104, a latch 105, an ink tube 136, a sub system 181, and a receiver 185.

The frame 101 includes side plates 101A and 101B, and a back plate 101C. The sub system 181 includes caps 182, a wiper blade 183, and a receiver 184.

The frame 101 is configured to hold the guide rod 131 and the latch 105. The side plates 101A and 101B are configured to hold the guide rod 131. The back plate 101C is configured to hold the latch 105. The latch 105 is configured to hold the ink tube 136. The harness 102 is configured to connect the recording heads 134 with a controller (not shown). The ink tube 136 is configured to supply ink from the ink cartridges 20*k*, 20*c*, 20*m*, and 20*y* to the sub tanks 135. The pump unit 104 is configured to pump ink from the ink cartridges 20*k*, 20*c*, 20*m*, and 20*y* to the sub tanks 135. The sub system 181 is configured to maintain and restore the nozzles of the recording heads 134. The caps 182 are configured to cap the nozzles of the recording heads 134. The wiper blade 183 is configured to wipe the nozzles of the recording heads 134. The receivers 184 and 185 are configured to receive ink drops not used for recording an image on the recording sheet 30.

The guide rod 131 is horizontally laid between the side plates 101A and 101B. The guide rod 131 and the stay 132 hold the carriage 133. A main scanning motor (not shown) drives the carriage 133 to slide in a direction G (i.e., the main scanning direction).

The recording heads 134 include a driver IC (integrated circuit) and are connected with the controller via the harness 102 (i.e., a flexible print cable).

The carriage 133 includes the sub tanks 135. Inks in the black, cyan, magenta, and yellow colors are supplied from the ink cartridges 20*k*, 20*c*, 20*m*, and 20*y* to the sub tanks 135. The pump unit 104 is disposed in the ink cartridge holder 14.

The sub system 181 is disposed near one end portion of the guide rod 131 in the main scanning direction. The receiver 185 is disposed near the other end portion of the guide rod 131 in the main scanning direction. Both of the end portions are not used to print an image on the recording sheet 30.

The recording sheet 30 is fed one by one from the paper tray 2. The guide 145 guides the fed recording sheet 30 upward. The guided recording sheet 30 is fed between the transfer belt 151 and the counter roller 152. The transfer guide 153 guides a foremost edge of the fed recording sheet 30 to turn the recording sheet 30 by about 90 degrees. The pressing roller 155 presses the guided recording sheet 30 onto the transfer belt 151.

A high-voltage power supply (not shown) applies an alternating voltage to the charging roller 156 through a control circuit (not shown). The transfer belt 151 is alternatively charged with positive and negative electric charges. The positive and negative electric charges are alternatively applied with a predetermined width in a rotating direction (i.e., the sub-scanning direction) of the transfer belt 151. When the recording sheet 30 is fed onto the transfer belt 151 alternatively charged with the positive and negative electric charges, the transfer belt 151 attracts the recording sheet 30. The rotating transfer belt 151 conveys the recording sheet 30 in the sub-scanning direction.

While the carriage 133 moves, the recording heads 134 are driven in accordance with image signals. The recording heads 134 eject ink drops onto the recording sheet 30 to record an image for one line while the recording sheet 30 stops. After the recording sheet 30 is conveyed for a predetermined length in the rotating direction of the transfer belt 151, recording for another line is performed. When a signal notifying that recording is finished or a signal notifying that a tail edge of the recording sheet 30 passes the print area is received, the image forming apparatus 1 finishes recording and outputs the recording sheet 30 onto the output tray 3.

Figure 21:
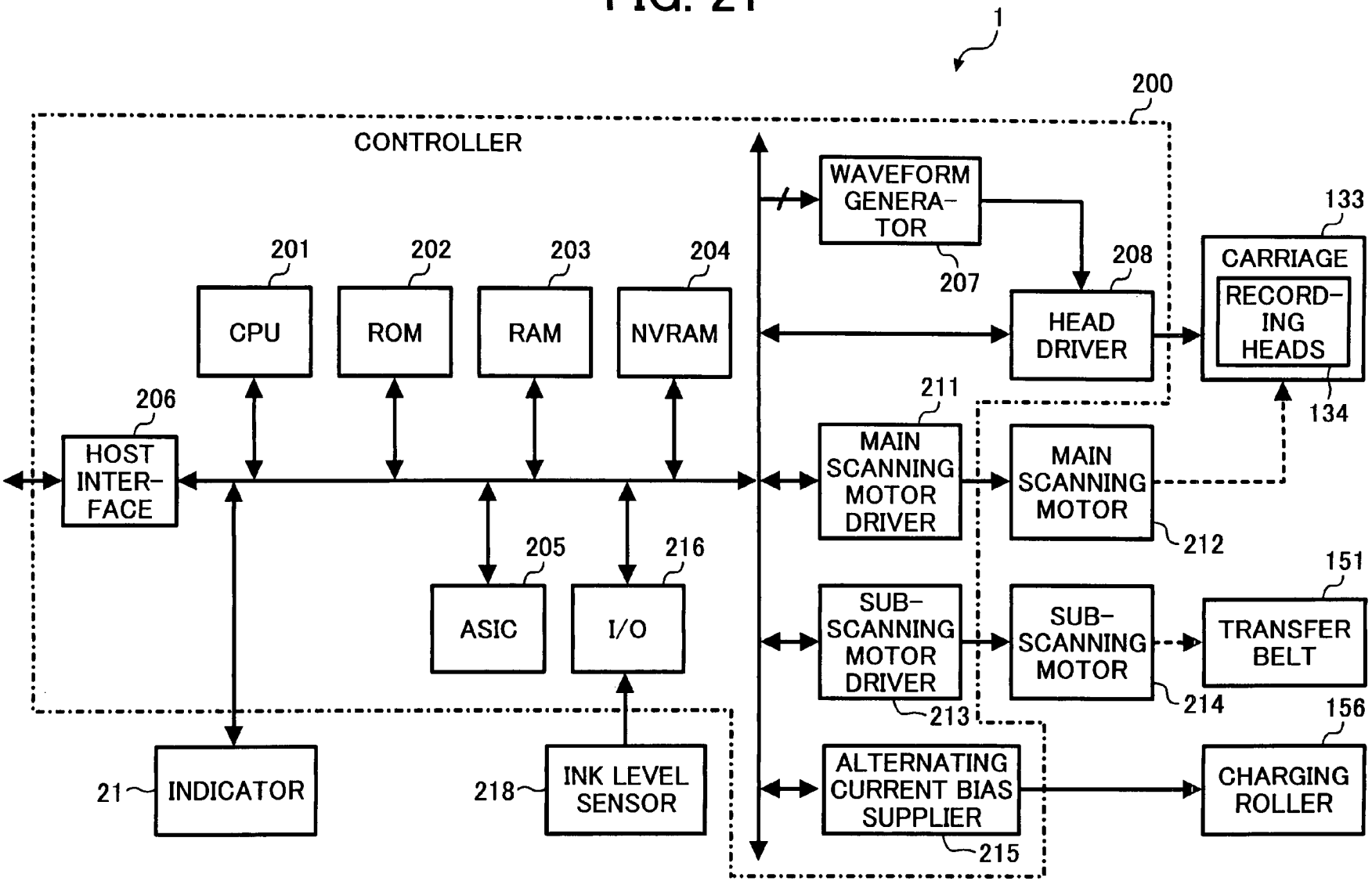
FIG. 21 is a block diagram of a controller of the image forming apparatus shown in FIG. 9.

As illustrated in FIG. 21, the image forming apparatus 1 further includes a controller 200, a main scanning motor 212, a sub-scanning motor 214, and an ink level sensor 218.

The controller 200 includes a CPU (central processing unit) 201, a ROM (read-only memory) 202, a RAM (random access memory) 203, an NVRAM (nonvolatile random access memory) 204, an ASIC (application specific integrated circuit) 205, a host interface 206, a waveform generator 207, a head driver 208, a main scanning motor driver 211, a sub-scanning motor driver 213, an alternating current bias supplier 215, and an I/O (input/output) 216.

The controller 200 is configured to control the image forming apparatus 1. The main scanning motor 212 is configured to move the carriage 133 in the main scanning direction. The sub-scanning motor 214 is configured to rotate the transfer belt 151 in the sub-scanning direction.

The ink level sensor 218 is configured to detect an amount of ink remaining in the ink bag 62. The ink level sensor 218 sends a detection signal to the I/O 216. The controller 200 flashes the indicator 21 when the ink level sensor 218 detects that the ink cartridge 20 is almost empty or empty. The controller 200 lights the indicator 21 when the ink level sensor 218 detects that the ink cartridge 20 is empty. Thus, the indicator 21 prompts the operator to replace the ink cartridge 20.

The CPU 201 is configured to read and analyze print data received in a receive buffer of the host interface 206. The ROM 202 is configured to store a program executed by the CPU 201 and other fixed data. The RAM 203 is configured to temporarily store image data. The NVRAM 204 is configured to keep data while power is not supplied to the image forming apparatus 1.

The ASIC 205 is configured to process various signals for image processing and input and output signals for controlling the entire image forming apparatus 1. The ASIC 205 performs image processing such as sorting on the print data, and then sends the processed image data to the head driver 208. To generate dot pattern data for outputting an image, the ROM 202 may store font data. Otherwise, a printer driver installed in the host may convert image data into bitmap data and send the converted data to the image forming apparatus 1.

The host interface 206 is configured to send and receive data and signals to and from a host (i.e., an image processing device or a data processing device such as a personal computer). The host interface 206 receives print data including image data sent from a host via a cable or a network. The host includes an image processing device such as a personal computer, an image scanning device such as an image scanner, and a shooting device such as a digital camera.

The waveform generator 207 is configured to generate a waveform for driving the recording heads 134. The waveform generator 207 includes a digital-analog converter (not shown) for performing digital-analog conversion on driving pulse pattern data. The waveform generator 207 sends a waveform to the head driver 208. The waveform includes one driving pulse and a plurality of driving pulses satisfying the above conditions.

The head driver 208 is configured to drive and control the recording heads 134. The head driver 208 selectively applies the driving pulse forming the waveform sent from the waveform generator 207 to an actuator of the recording heads 134 based on data (i.e., dot pattern data) of an image for one line serially created by the recording heads 134. Thus, the head driver 208 drives the recording heads 134.

The main scanning motor driver 211 is configured to drive the main scanning motor 212. The sub-scanning motor driver 213 is configured to drive the sub-scanning motor 214. The alternating current bias supplier 215 is configured to apply an alternating current bias voltage to the charging roller 156. The I/O 216 is configured to input detection signals sent from various sensors.

The present invention has been described above with reference to specific embodiments. The present invention is not, however, limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

a plurality of recording liquid cartridges configured to contain recording liquids of colors different from each other;

a cartridge holder configured to protrude from a front of the image forming apparatus and to hold the plurality of recording liquid cartridges in the apparatus;

a cartridge cover provided in a front of the cartridge holder and including a see-through portion through which the plurality of recording liquid cartridges are visible, and configured to enclose the plurality of recording liquid cartridges held by the cartridge holder inside the apparatus and to be opened to allow an operator access to attach and detach each of the plurality of recording liquid cartridges to and from the front of the image forming apparatus in a substantially horizontal direction; and a plurality of indicators configured to indicate information relating to amounts of the recording liquids remaining in respective of the plurality of recording liquid cartridges and disposed on a top surface of the cartridge holder protruding from a front surface of the image forming apparatus at positions deviated from the cartridge cover, and disposed at positions corresponding to and above respective positions of the plurality of recording liquid cartridges placed in the cartridge holder, wherein each of the plurality of indicators emits light in a color representing a color of a recording liquid contained in a corresponding one of the plurality of recording liquid cartridges.

2. The image forming apparatus according to claim 1, further comprising:

a plurality of indexes, each of which is disposed near a corresponding indicator of the plurality of indicators and configured to indicate a color representing a color of a recording liquid contained in a corresponding one of the plurality of recording liquid cartridges.

3. The image forming apparatus according to claim 2, wherein the cartridge holder includes a control panel to set controls of the image forming apparatus, and the plurality of indicators and plurality of indexes are formed on the control panel.

4. The image forming apparatus according to claim 1, wherein the plurality of recording liquid cartridges are placed in a portrait orientation and are horizontally aligned in the cartridge holder.

5. The image forming apparatus according to claim 1, wherein the cartridge holder includes a control panel to set controls of the image forming apparatus.

6. The image forming apparatus according to claim 1, wherein the cartridge holder is fixed in the image forming apparatus and is separately provided from a carriage carrying recording heads, the carriage including sub-tanks to receive respective inks from corresponding of the recording liquid cartridges in the cartridge holder.

7. The image forming apparatus according to claim 1, further comprising a top cover of the image forming apparatus, and wherein the cartridge cover is provided separately from the top cover of the image forming apparatus.

8. The image forming apparatus according to claim 1, further comprising a paper tray and an output tray, and wherein further the paper tray and the output tray are provided on the front of the image forming apparatus, the output tray is provided above the paper tray, and the cartridge holder is provided adjacent to the paper tray and the output tray and near one side of the image forming apparatus.

9. An image forming apparatus, comprising:

a plurality of means for containing recording liquids of colors different from each other;

means for holding the plurality of means for containing in the image forming apparatus, and that protrudes from a front of the image forming apparatus;

means for enclosing the plurality of means for containing held by the means for holding inside the image forming apparatus and provided in a front of the means for holding, and including a see-through portion through which the plurality of means for containing are visible, and for being opened to allow an operator access to attach and detach each of the plurality of means for containing to and from the front of the image forming apparatus in a substantially horizontal direction;

a plurality of means for indicating information relating to amounts of the recording liquids remaining in respective of the plurality of means for containing and disposed on a top surface of the means for holding protruding from a front surface of the image forming apparatus at positions deviated from the means for enclosing, and disposed at positions corresponding to respective positions of the plurality of means for containing placed in the means for holding; and a plurality of means for indicating a color representing a color of a recording liquid contained in a corresponding one of the plurality of means for containing and being disposed near a corresponding means for indicating information of the plurality of means for indicating information.

10. The image forming apparatus according to claim 9, wherein the means for holding includes a control panel to set controls of the image forming apparatus.

11. The image forming apparatus according to claim 9 wherein the means for holding includes a control panel to set controls of the image forming apparatus, and the plurality of means for indicating information and plurality of means for indicating a color are formed on the control panel.

12. The image forming apparatus according to claim 9, wherein the means for holding is fixed in the image forming apparatus and is separately provided from a carriage carrying recording heads, the carriage including sub-tanks to receive respective inks from corresponding of the means for containing recording liquids in the means for enclosing.

13. A method for use in a system ejecting ink drops onto a recording sheet to record an image on the recording sheet, the method comprising:

keeping recording liquids of colors different from each other in a plurality of recording liquid cartridges;

holding the plurality of recording liquid cartridges with a cartridge holder in an image forming apparatus, the cartridge holder protruding from a front of the image forming apparatus;

enclosing the plurality of recoding liquid cartridges held by the cartridge holder inside the apparatus with a cover including a see-through portion through which the plurality of recording liquid cartridges are visible, the cover provided in a front of the cartridge holder;

opening the cover to allow an operator access to attach and detach each of the plurality of recording liquid cartridges to and from the front of the image forming apparatus in a substantially horizontal direction;

forming a plurality of indicators on a top surface of the cartridge holder protruding from a front surface of the image forming apparatus at positions deviated from the cartridge cover, and at positions corresponding to respective positions of the plurality of recording liquid cartridges placed in the cartridge holder to indicate information relating to amounts of respective of the recording liquids remaining in the plurality of recording liquid cartridges; and emitting light in a color representing a color of a recording liquid contained in a corresponding one of the plurality of recording liquid cartridges.

14. The method according to claim 13, further comprising:

forming each of a plurality of indexes near a corresponding indicator of the plurality of indicators to indicate a color representing a color of a recording liquid contained in a corresponding one of the plurality of recording liquid cartridges.

15. The method according to claim 14, further comprising:

placing the plurality of recording liquid cartridges in a portrait orientation and horizontally aligning the plurality of recording liquid cartridges in the cartridge holder.

16. The image forming method according to claim 13, wherein the cartridge holder is fixed in the image forming apparatus and is separately provided from a carriage carrying recording heads, the carriage including sub-tanks to receive respective inks from corresponding of the recording liquid cartridges in the cartridge holder.

* * * * *